United States Patent [19]

Studer

[11] 4,299,336

[45] Nov. 10, 1981

[54] CAULKING GUN WITH FLOW STOPPER

[75] Inventor: Lewis O. Studer, Summerfield, Ohio

[73] Assignee: Melern Development, Canton, Ohio

[21] Appl. No.: 128,387

[22] Filed: Mar. 10, 1980

[51] Int. Cl.[3] ..... B65D 47/38; B67D 5/46

[52] U.S. Cl. ..... 222/80; 222/387; 222/561

[58] Field of Search ..... 222/80, 387, 391, 528, 222/541, 561, 82, 83; 138/94.3

[56] References Cited

U.S. PATENT DOCUMENTS

| | | | |
|---|---|---|---|
| 1,846,167 | 2/1932 | Wallen | 222/391 X |
| 2,244,071 | 6/1941 | Landrus | 222/561 X |
| 2,317,299 | 4/1943 | Peters | 222/391 X |
| 2,528,662 | 11/1950 | Miller | 222/561 X |
| 2,659,517 | 11/1953 | Reinhardt, Jr. | 222/387 X |

FOREIGN PATENT DOCUMENTS

| | | | |
|---|---|---|---|
| 837942 | 3/1970 | Canada | 222/391 |
| 1201104 | 12/1959 | France | 222/391 |

*Primary Examiner*—David A. Scherbel
*Attorney, Agent, or Firm*—Frease & Bishop

[57] ABSTRACT

An improved caulking gun has a usual semicylindrical frame with a disc-shaped rear wall and a split front wall. A handle and trigger mechanism is mounted on the rear of the frame for advancing a plunger forwardly within the tube to discharge caulking material from the tube through the spout. A guide channel is mounted on and extends along the bottom of the frame and curves upwardly along and is spaced from the split front end. A flat strip of flexible metal is slidably mounted in the channel and has a front cutting edge which cuts partially through the plastic spout when a new tube is placed in the frame. The outer end of the metal strip blocks the flow of caulking material from the spout. A lever is pivotally mounted on the guide channel and is engaged with the metal strip for moving the strip between a flow-blocking position and an open material-discharge position. The cut area of the spout is clamped in a U-shaped saddle at the end of the guide channel by a keeper plate, which in addition to preventing the spout from separating at the cut area, deforms the spout into a generally squared configuration to provide a positive seal with the edges of the outer end of the metal strip. The metal strip can be moved repeatedly between open and closed positions during a caulking operation to more accurately control the discharge of caulking material from the spout.

18 Claims, 12 Drawing Figures

CAULKING GUN WITH FLOW STOPPER

BACKGROUND OF THE INVENTION

1. Field of the Invention

The invention relates to caulking guns of the type which removably hold a tube of caulking material which is discharged through a spout at the end of the tube. More particularly, the invention relates to an improved caulking gun which has a manually operated flow-stopping slide valve which blocks the flow of caulking material within the spout when the valve is moved to a closed position.

2. Description of the Prior Art

There are various types and styles of caulking guns which hold a tube of caulking material in a generally trough-shaped frame. A trigger and handle mechanism is mounted on the rear of the frame for manually moving a plunger forwardly within the tube to force caulking material from the tube through an end spout by forcing the bottom wall of the tube axially along within the tube. The top or front wall of the tube is retained by the end wall of the frame which usually has a slotted opening through which the tube spout or nozzle projects. The plunger may have a series of ratchet teeth formed along a straight shaft portion thereof which are engaged by a spring-biased detent on the trigger mechanism for advancing the plunger within the tube and for retaining the plunger in its forwardmost position upon release of the pressure-applying trigger. Other caulking gun constructions, such as shown in U.S. Pat. No. 4,081,112, use a novel spring arrangement for retaining the plunger in its forward position.

One problem which is common with nearly all known manually actuated caulking guns is the continual discharge of the caulking material from the spout for a short period of time even after the pressure on the trigger mechanism has been released. This discharge will continue until the pressure within the tube of caulking material has equalized. This results in a waste of caulking material and can create a clean-up problem. Also, possible damage can occur to the surrounding area if the caulking is being done in an existing or finished dwelling or location. Even if the pressure which is applied to the plunger is released and the plunger retracted from within the tube of caulking material, a small amount of material will still flow from the end of the spout due to the pressure build-up within the caulking material. Such a manual retraction of the plunger after each application, although reducing the continual discharge problem, is extremely time consuming and difficult.

There is no known caulking gun construction of which I am aware which provides a positive manually actuated flow stopper which blocks the flow of caulking material within the spout in a simple, convenient and economical manner.

SUMMARY OF THE INVENTION

Objectives of the invention include providing an improved caulking gun construction having a flow stopper incorporated therein which positively blocks the flow of caulking material at a position within the spout closely adjacent to the discharge end of the tube of such caulking material, thereby preventing a large portion of the caulking material from becoming dry and hard when left for a period of time; providing such a caulking gun construction in which the flow-stopping device can be mounted on or incorporated into the usual type of caulking gun used today, which is of the type having a trough-shaped frame for holding a tube of caulking material and a plunger actuated by a handle and trigger mechanism to force the material from the tube; providing such a caulking gun in which the flow stopper has a forward cutting edge which cuts into the spout of the caulking material tube when initially actuated to ensure proper positioning of a slide valve slot in the spout through which a slide valve stopper subsequently reciprocates for repeatedly stopping and starting the material flow; providing such an improved caulking gun construction in which a clamping device is engageable with the tube spout at the location where the slide valve stopper blade cuts into the spout to prevent the spout from separating at the cut location; providing such a caulking gun in which the slide valve stopper is a strip of flexible sheet metal slidably mounted within a channel which is mounted on the bottom of the frame, and in which the stopper strip is moved between flow-stopping and flow-discharge positions by a manually actuated lever which is mounted on the channel and operatively engaged with the stopper strip; providing such a caulking gun in which the flow stopper mechanism can be formed relatively inexpensively of sheet metal components which are assembled into a complete unit for subsequent attachment to a usual caulking gun frame without requiring any modifications to the frame except at its attachment points; providing such a caulking gun construction which provides a positive flow-stopping action in a simple and inexpensive manner, which is easily operated, which eliminates problems existing in the art, satisfies needs and obtains new results in the art.

These objectives and advantages are obtained by the improved caulking gun construction, the general nature of which may be stated as including a frame adapted to removably receive a tube of caulking material; a plunger movably mounted with respect to the frame; a handle mounted on the frame; trigger means mounted on the handle for advancing the plunger forwardly to urge caulking material outwardly through a spout of the tube of caulking material; guide means mounted on the frame; blade means movably mounted on the guide means and engageable with the spout of the tube of caulking material and movable between a flow-blocking position and an open position; and lever means operatively engaged with the blade means to move said blade means between a flow-blocking position and an open position.

BRIEF DESCRIPTION OF THE DRAWINGS

A preferred embodiment of the invention—illustrative of the best mode in which applicant has contemplated applying the principle—is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 4:
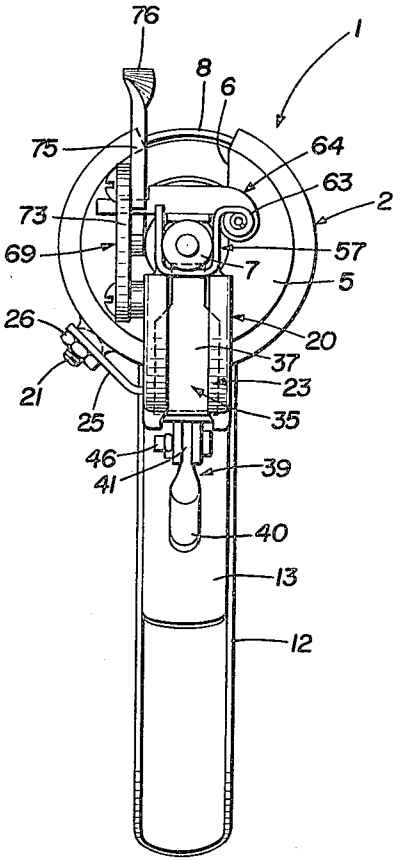
FIG. 4 is an enlarged front elevational view of the caulking gun construction shown in FIG. 2.
Figure 1:
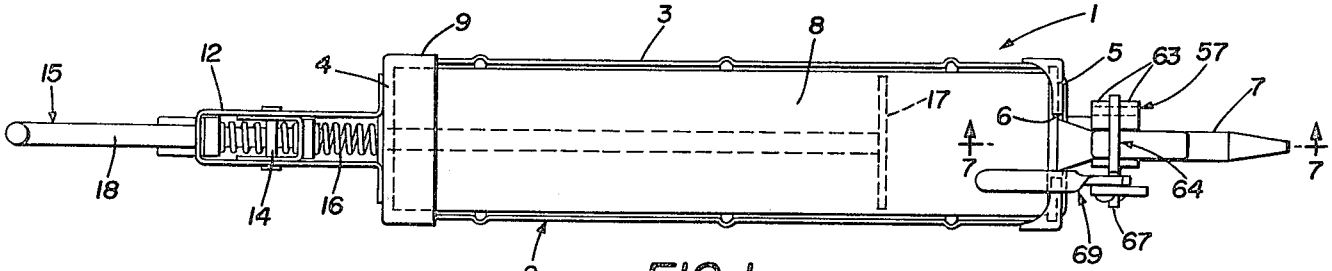
FIG. 1 is a top plan view of the improved caulking gun construction.

An improved caulking gun construction having the flow stopper means mounted thereon, is indicated generally at 1, and is shown particularly in FIGS. 1–4. Gun construction 1 includes a frame 2 formed by a semicylindrical wall 3 having a disc-shaped rear end wall 4 and a disc-shaped front end wall 5. Rear wall 4 and front wall 5 are attached to semicylindrical wall 3 by welding or other fastening means. Front wall 5 is formed with a radially extending slot 6 through which the spout 7 of a tube 8 of caulking material extends when tube 8 is placed within frame 2. Tube 8 is a usual cylindrical-shaped tube containing various types of caulking compounds. Tube 8 is removably mounted within the interior of semicylindrical wall 3 with the rear end of tube 8 being inserted beneath an axially extending flange portion 9 of end wall 4.

A handle 12 is attached to end wall 4 and includes a trigger 13 which is pivotally mounted by a pin 14 on handle 12. A plunger 15 is mounted on handle 12 and is moved axially along frame 2 by actuation of trigger 13 through a plurality of biasing springs 16 contained within handle 12. Plunger 15 includes a shaft 18 and a disc 17 mounted on the front end thereof. Disc 17 moves axially within the interior of tube 8 and expels the caulking compound therefrom in a usual manner through spout 7.

The above-described caulking gun configuration is readily known in the prior art and may be of the type shown in U.S. Pat. No. 4,081,112, which includes the specific type of spring-actuated trigger mechanism shown in the drawings. This construction may have other configurations without affecting the concept of the invention, such as having plunger shaft 18 formed with a plurality of ratchet teeth which are engaged with a spring detent of the trigger mechanism for advancing plunger disc 17 within tube 8. One of the features of the flow stopper mechanism is that it can be incorporated with or mounted on most known types of caulking guns.

In accordance with the invention, a flow stopper mechanism, indicated generally at 20 (FIG. 2) is mounted on the bottom of semicylindrical frame wall 3 on front and rear threaded studs 21 and 22, respectively, which are welded or brazed on wall 3.

Stopper mechanism 20 includes a guide channel member 23 which is mounted in a spaced relationship beneath the bottom of frame wall 3 by tabs 24 and 25 which are mounted on threaded studs 21 and 22, respectively, by nuts 26. Guide channel member 23 (FIGS. 11 and 12) has a generally elongated C-shape formed by a main wall 27 and a pair of inwardly extending end walls 28 which form a guide channel 29 therebetween. Channel member 23 (FIG. 2) includes a straight portion 30 which extends generally parallel with and beneath frame wall 3 and an integral curved front portion 31 which extends upwardly from the bottom of frame 3 parallel with frame front wall 5.

Figure 9:
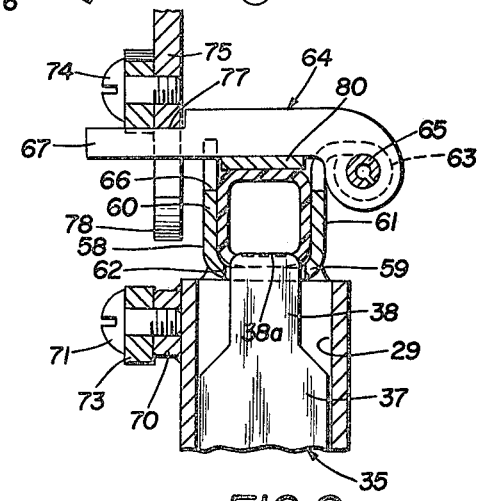
FIG. 9 is an enlarged fragmentary sectional view taken on line 9—9, FIG. 7.
Figure 8:
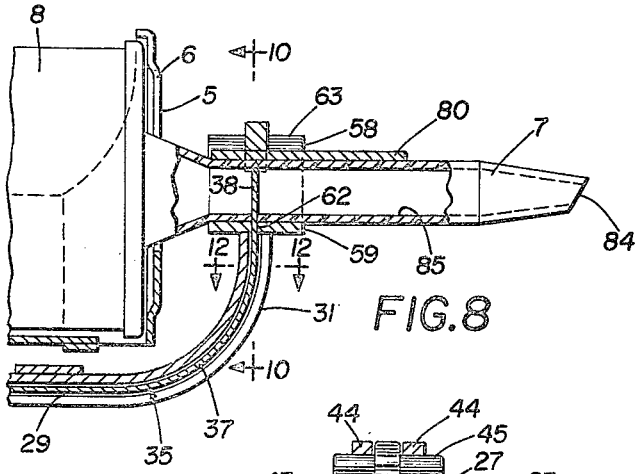
FIG. 8 is a view similar to FIG. 7, with the slide blade shown in flow-stopping position.

A slide valve or blade 35 is movably slidably mounted within guide channel 29 (FIGS. 7–10). Blade 35 includes a rigid base portion 36 and an elongated flexible front portion 37 formed of a thin strip of flexible metal. Blade 35 terminates in a reduced end 38 which terminates in a cutting edge **38*a* (FIG. 9). Blade 35 is moved within guide channel 29 between a flow-blocking position of FIG. 8 and a spout-open or discharge position of FIG. 7 by a lever mechanism indicated generally at 39**.

Figure 5:
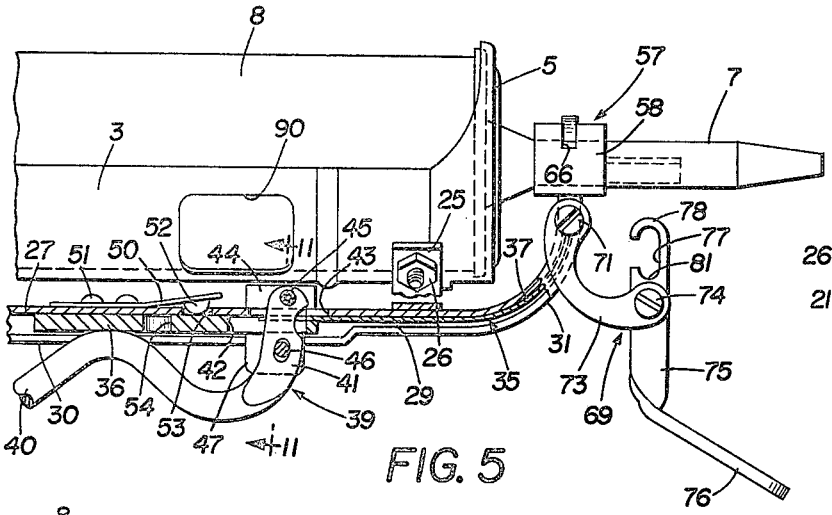
FIG. 5 is an enlarged fragmentary view, with portions broken away and in section, of the front portion of the caulking gun construction as shown in FIG. 2, with the spout keeper latch shown in unlatched position.
Figure 11:
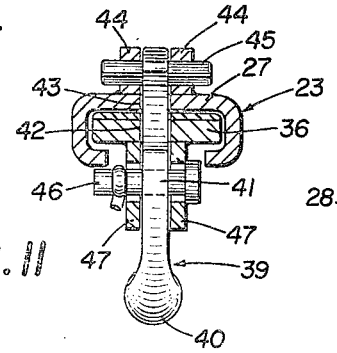
FIG. 11 is an enlarged fragmentary sectional view taken on line 11—11, FIG. 5.
Figure 12:
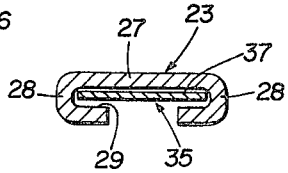
FIG. 12 is an enlarged fragmentary sectional view taken on line 12—12, FIG. 8.

Lever mechanism 39 includes a manually operated lever 40 (FIG. 2) which terminates in a reduced thickness inner end 41 (FIG. 5). End 41 extends through aligned slots 42 and 43 formed in blade base portion 36 and in channel wall 27, respectively (FIG. 11). Lever end 41 is pivotally mounted on channel member 23 by a pair of upwardly projecting spaced tabs 44 and a pivot pin 45. Reduced lever end 41 also is movably pivotally connected to blade base 36 by a pin 46 which extends between a pair of spaced tabs 47 which are attached to and extend downwardly from blade base 36.

A leaf spring 50 (FIG. 5) is attached by a pair of fasteners 51 to the outer surface of channel wall 27 and has a bead 52 mounted on the outer end thereof. Bead 52 extends through a hole 53 formed in channel wall 27 and is adapted to project into an aligned hole 54 formed in blade base portion 36 when blade 35 is in the flow-stopping position. The spring-biasing force exerted by leaf spring 50 on bead 52 retains blade 35 in its flow-blocking position until lever 40 is manually moved to the discharge position.

Figure 10:
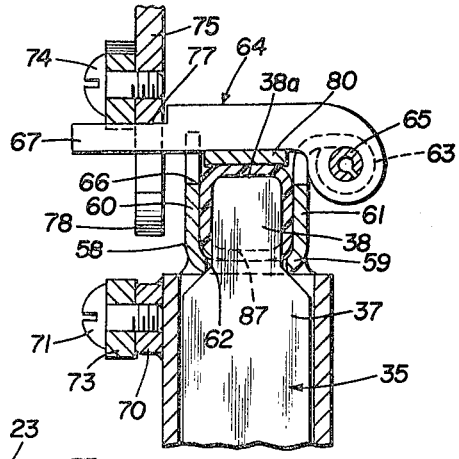
FIG. 10 is an enlarged fragmentary sectional view taken on line 10—10, FIG. 8.

A spout keeper mechanism, indicated generally at 57 (FIGS. 5–10), is mounted on the upper end of guide channel 29 and is adapted to engage and surround a portion of tube spout 7 at the area where slide blade 35 blocks the flow of caulking material. Keeper mechanism 57 includes a generally U-shaped saddle 58 which is welded to the top end of channel member 29. Saddle 58 is formed by a base 59 and a pair of spaced upstanding legs 60 and 61, which form generally right angles with base 59 to provide a squared bottom configuration for saddle 58. Saddle base 59 is formed with a horizontally extending slot 62 (FIG. 9) through which reduced blade end 38 extends when blocking the flow of caulking material. Saddle leg 61 terminates in a pair of spaced rolled flanges 63 with a keeper bar 64 being pivotally mounted therebetween by a pin 65. The other saddle leg 61 is formed with a slot 66 which receives an outer end 67 of keeper bar 64 when bar 64 is in a spout-clamping position (FIGS. 9 and 10). Saddle 58 preferably has an inwardly tapered configuration in the axial direction to better conform with the tapered configuration of spout 7, when the spout is deformed therein, as described below, to ensure a satisfactory seal with blade end 38.

Alternately, spout 7 can be manufactured to have a squared configuration at the area of engagement with saddle 58.

Keeper mechanism 57 also includes a latch, indicated generally at 69 (FIG. 5), which is pivotally mounted adjacent the base of U-shaped saddle 58 (FIG. 9) by a stud 70 and a screw 71 which is threadedly engaged therewith. Latch 69 includes a curved link 73 which is pivotally mounted at one end on stud 70 by screw 71 and is pivotally connected at its other end by a screw 74 to a latching lever 75. Lever 75 terminates at one end in a finger tab 76 for manually operating latch 69 and at its other end in a slot 77 formed by a hook end 78. Outer end 67 of keeper bar 64 is received within slot 77 of lever 75 when securing bar 64 in a tube spout-clamping position. Keeper bar 64 has an axially extending, elongated metal plate 80 welded to the bottom of bar 64. Plate 80 is adapted to extend along a portion of spout 7 (FIGS. 7 and 9) in order to retain, reinforce and deform the area of spout 7, which is located in saddle 58 at the flow-blocking region.

Figure 6:
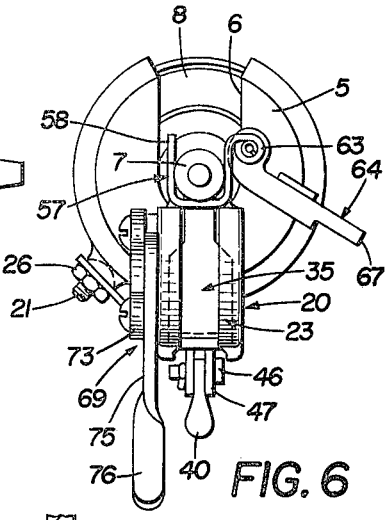
FIG. 6 is a right-hand front view of the arrangement shown in FIG. 5.
Figure 7:
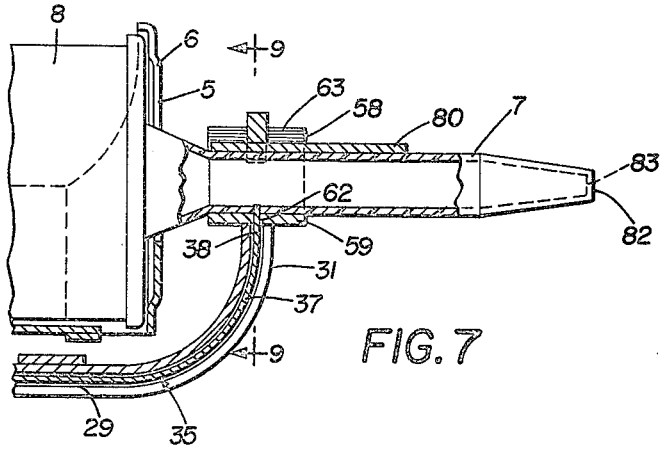
FIG. 7 is an enlarged fragmentary sectional view taken on line 7—7, FIG. 1, with the slide blade shown in open position.

The operation of the improved caulking gun construction is described briefly below. A tube 8 of caulking or other flowable material is placed within frame wall 3 in a usual manner with spout 7 projecting through front wall slot 6. Lever 40 is in the solid line position of FIG. 2 when tube 8 is initially placed in frame 2, wherein blade 35 is in the open, material-discharge position of FIGS. 7 and 9. Latch 69 will be in the open position of FIGS. 5 and 6 with spout 7 being seated within U-shaped saddle 58, as shown in FIGS. 5 and 6. Trigger 13 is actuated just enough to move tube 8 forwardly into abutment against frame front wall 5. Keeper bar 64 then is pivoted on pin 65 toward the closed position of FIG. 9 with plate 80 lying along the top surface of a portion of spout 7. Keeper bar end 67 is placed in slot 77 of latch lever 75 and is abutted against the rear curved surface 81 of slot 77. Lever tab end 76 then is pivoted upwardly in a counterclockwise direction (FIGS. 2 and 5) from the unlatched position of FIG. 5 to the latched position of FIG. 2. This movement clamps plate 80 tightly against spout 7, forcing spout 7 tightly downwardly between saddle legs 60 and 61. Keeper bar 64 and plate 80 force spout 7 into a generally squared configuration, as shown in FIG. 10, whereby the inner surfaces of the squared spout walls make contact along the side and top edges of blade end 38 to provide a positive sealing engagement therebetween when blade 35 is in a flow-blocking position.

Next, the outer tip 82 of spout 7 is severed at an angle (FIGS. 7 and 8) to remove end seal 83 therefrom to provide an outer discharge opening 84. A nail or similar sharp object then is inserted through opening 84 to pierce a diaphragm (not shown) located within tube 8 at the junction with spout 7. Upon manual actuation of trigger 13, plunger 15 and disc 17 will move axially forwardly within tube 8, forcing caulking material from tube 8 through hollow bore 85 and discharge opening 84 of spout 7 onto an area to be caulked. Upon completion of a caulking application, lever 40 is moved manually in a counterclockwise direction from the full line position to the dot-dash line position of FIG. 2. This pivotal movement of lever 40 moves slide valve or blade 35 along guide channel 29 due to the pivotal connection therebetween achieved by tabs 47 and pin 46 (FIG. 11). Reduced blade end 38 will move from the open position of FIG. 7 to the flow-blocking or closed position of FIG. 8. Blade edge 38*a* will cut through a portion of spout 7 when moving initially from the open position of FIG. 9 to that of FIG. 10, forming an opening 87 in a bottom portion of spout 7 which aligns with slot 62 of U-shaped saddle 58. Most spouts 7 are formed of a relatively soft plastic material which enables blade edge 38*a* to easily cut through the tube wall. During repeated movement of slide blade 35 between open and closed positions, reduced blade end 38 will pass through this same slotted opening which is initially cut into spout 7.

Reduced blade end 38 may cut slightly into the sides and top portion of spout 7 (as shown in FIG. 10) in order to provide an effective seal for bore 85 of spout 7. Keeper bar 64, in combination with saddle 58 and reinforcing plate 80, clamp spout 7 about slotted opening 87 in a fixed position to prevent movement of the outer end of spout 7 and possible separation thereof from the remaining spout portion. More importantly, bar 64 and plate 80 deform spout 7 into a generally squared configuration within saddle 58 to provide a positive seal with the edges of blade end 38. Since slotted opening 87 in spout 7 was initially made by blade end 38, it will remain aligned with the blade end during repeated movements of blade 35 between open and closed positions. Blade end 38*a* will remain in slotted opening 87 of spout 7 when blade 35 is in open position in order to seal opening 87 to prevent escape of any caulking material therethrough as the material moves through spout bore 85.

Figure 2:
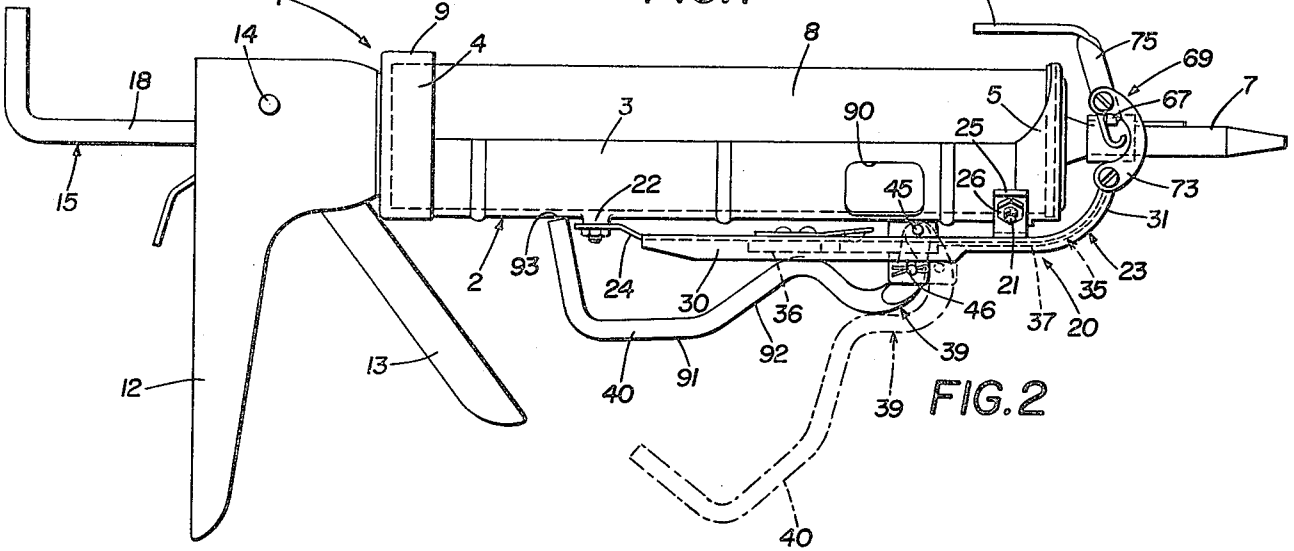
FIG. 2 is a side elevational view of the caulking gun construction shown in FIG. 1, with the operating lever shown in full lines in flow-open position and in dot-dash lines in flow-blocking position.
Figure 3:
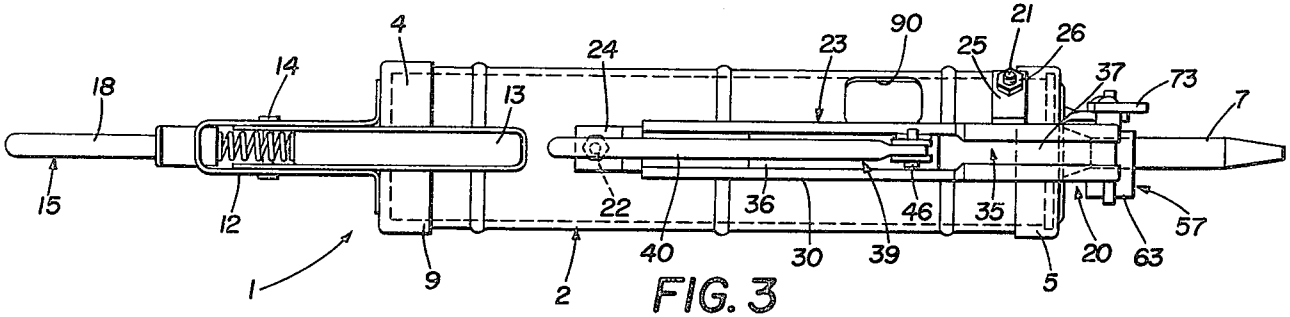
FIG. 3 is a bottom plan view of the caulking gun shown in FIGS. 1 and 2.

Lever 40 has the particular bent arrangement, shown in FIG. 2, to provide an easily gripped and operable lever device. A person, upon operating lever 40, will grip the horizontal rear portion 91 thereof with his thumb extending along the inwardly extending adjacent portion 92. The swinging end 93 of lever 40 abuts the bottom of semicylindrical frame wall 3 to limit the movement of blade 35 and lever 40 when moved to an open material-discharge position to ensure that blade edge 38*a* remains in slotted opening 87 of spout 7

The improved caulking gun construction with the flow stopper means incorporated therein provides an easily operated mechanism for positively stopping the flow of caulking material from the spout upon release of trigger 13. The small portion of caulking material remaining in the outer end of the spout will not have sufficient internal pressure to completely discharge the same from end opening 84, since the pressure created within the main body of caulking material is blocked by blade end 38.

It has been found that formation of a small rectangular opening 90 (FIGS. 2 and 5) in semicylindrical frame wall 3 greatly facilitates the removal of a tube 8 from within frame 2 after the caulking material has been exhausted. In order to remove an empty tube 8 from frame 2, keeper mechanism 57 is unlatched from its clamping position with spout 7 by movement of lever tab end 76 in a clockwise direction (FIG. 2). Lever 40 is moved to a spout-open position, wherein blade end 38 is removed from spout bore 85, facilitating the removal of empty tube 8 from frame 2 in a usual manner.

Although the above description and drawings refer to a caulking gun construction for use with tubes of caulking material, the improved flow stopper mechanism 20 can be used with similar guns which hold tubes of grease or other flowable material. Therefore, the subject invention need not be limited to only guns containing tubes of caulking material.

Accordingly, the improved caulking gun construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved caulking gun is constructed and used, the characteristics of the construction, and the advantageous, new and useful results obtained; the new and useful structures, devices, elements, arrangements, parts, and combinations, are set forth in the appended claims.

I claim:

1. An improved caulking gun construction of the type having a frame, a plunger, a handle and a trigger mechanism for advancing the plunger forwardly for urging caulking material outwardly through a spout of a tube of caulking material mounted on the frame, and in which the spout is formed of a severable material, wherein the improvement includes:

(a) guide means mounted on the frame;

(b) blade means movably mounted on the guide means and engageable with the spout of the tube of caulking material and movable between a flow-blocking position and an open position, said blade means being adapted to cut through a side of the spout and abut a far side of said spout to block the flow of caulking material from the spout when the blade means is in the flow-blocking position; and (c) lever means operatively engaged with the blade means to move said blade means between a flow-blocking position and an open position.

2. The construction defined in claim 1 in which the guide means includes a channel having a straight portion which extends along the bottom of the frame and an integrally connected curved portion which extends upwardly across the front of the frame; and in which keeper means is mounted on the curved channel portion and is adapted to engage the spout of a tube of caulking material.

3. The construction defined in claim 2 in which the keeper means includes a U-shaped saddle formed by a pair of spaced legs adapted to receive the tube spout therebetween, and a latch plate pivotally mounted on the saddle and adapted to extend across the top of said saddle and engage the tube spout to clamp the spout in said saddle.

4. The construction defined in claim 3 in which the latch plate is pivotally mounted on one of the legs of the U-shaped saddle; and in which a latch is pivotally mounted on the other saddle leg and is engageable with the latch plate to secure said latch plate in a spout clamping position across the saddle.

5. The construction defined in claim 1 in which the lever means includes a lever which is pivotally mounted at one end on the guide means and is operatively engaged with the blade means to move said blade means along the guide means upon pivotal movement of the lever.

6. The construction defined in claim 5 in which the blade means includes a flat strip of flexible metal, the forward end of which is formed with a cutting edge; and in which the cutting edge is adapted to cut through the side of the tube spout when the blade means is initially moved to the flow-blocking position.

7. The construction defined in claim 6 in which a pair of spaced tabs is mounted on the blade means; and in which pin means extends between the tabs and through a hole formed in the lever to operatively connect the lever to the blade means.

8. The construction defined in claim 5 in which the other end of the lever abuttingly engages the frame to limit further movement of the lever means and blade means after the blade means has moved to open position.

9. The construction defined in claim 1 in which spring detent means is operatively engaged with the blade means when the blade means is in the flow-blocking position to urge said blade means to remain in said flow-blocking position.

10. A gun construction including:

(a) a frame adapted to removably receive a tube of viscous material;

(b) a plunger movably mounted with respect to the frame;

(c) a handle mounted on the frame;

(d) trigger means mounted on the handle for advancing the plunger forwardly to urge material outwardly through a spout of the tube of viscous material;

(e) guide means mounted on the frame;

(f) blade means movably mounted on the guide means and engageable with the spout of the tube of viscous material and movable between a flow-blocking position and an open position, said blade means being adapted to cut through a side of the spout and abut a far side of said spout to block the flow of viscous material from the spout when the blade means is in the flow-blocking position; and (g) lever means operatively engaged with the blade means to move said blade means between a flow-blocking position and an open position.

11. The construction defined in claim 10 in which keeper means is mounted on the guide means and clampingly engages the tube spout to secure to the tube spout in a fixed position with respect to the guide means and blade means.

12. The construction defined in claim 11 in which slot means is formed in the keeper means; and in which the blade means projects through said slot means and into a slot formed in the tube spout by the blade means after it cuts through a side of the spout to block the flow of viscous material from the spout when the blade means is in a flow-blocking position.

13. The construction defined in claim 10 in which the blade means includes a rigid base and an elongated strip of flexible spring metal attached to the base and extending outwardly therefrom; and in which the lever means is operatively engaged with the rigid base of the blade means.

14. The construction defined in claim 10 in which leaf spring means is mounted on the guide means and engages the blade means when the blade means is in the flow-blocking position to assist said blade means to remain in said flow-blocking position.

15. The construction defined in claim 10 in which the viscous material is a caulking compound.

16. An improved caulking gun construction of the type having a frame, a plunger, a handle and a trigger mechanism for advancing the plunger forwardly for urging caulking material outwardly through a spout of a tube of caulking material mounted on the frame, and in which the spout is formed of a severable material, wherein the improvement includes:

(a) guide means mounted on the frame, said guide means including a channel having a straight portion which extends along the bottom of the frame and an integrally connected curved portion which extends upwardly across the front of the frame;

(b) keeper means mounted on the curved channel portion and engageable with the spout of the tube for securing the tube spout in a fixed position with respect to the guide means;

(c) blade means movably mounted on the guide means and engageable with the spout and movable between a flow-blocking position and an open position; and (d) lever means operatively engaged with the blade means for moving said blade means between a flow-blocking position and an open position.

17. The construction defined in claim 16 in which the keeper means includes a U-shaped saddle formed by a pair of spaced legs adapted to receive the tube spout therebetween, and a latch plate pivotally mounted on the saddle and adapted to extend across the top of said saddle and engage the tube spout to clamp the spout in said saddle.

18. The construction defined in claim 17 in which the latch plate is pivotally mounted on one of the legs of the U-shaped saddle; and in which a latch is pivotally mounted on the other saddle leg and is engageable with the latch plate to secure said latch plate in a spout clamping position across the saddle.

* * * * *